US006502918B1

(12) United States Patent
Seaver et al.

(10) Patent No.: US 6,502,918 B1
(45) Date of Patent: Jan. 7, 2003

(54) FEATURE IN FIRING CHAMBER OF FLUID EJECTION DEVICE

(75) Inventors: Richard W Seaver, Corvallis, OR (US); Timothy L Weber, Corvallis, OR (US); James A Mott, San Diego, CA (US); Dustin W Blair, San Diego, CA (US); Charles C Haluzak, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/942,475

(22) Filed: Aug. 29, 2001

(51) Int. Cl.[7] ..... B41J 2/15; B41J 2/05

(52) U.S. Cl. ..... 347/20; 347/67

(58) Field of Search ..... 347/62, 64, 65, 347/20, 67

(56) References Cited

U.S. PATENT DOCUMENTS 4,596,994 A * 6/1986 Matsuda et al. ..... 347/64
4,914,562 A * 4/1990 Abe et al. ..... 347/63
4,965,594 A * 10/1990 Komuro ..... 347/62

FOREIGN PATENT DOCUMENTS

JP 403213355 * 9/1991

* cited by examiner

*Primary Examiner*—Craig Hallacher
*Assistant Examiner*—Michael S. Brooke

(57) ABSTRACT

A fluid ejection device has a firing chamber with a feature disposed therewithin.

9 Claims, 10 Drawing Sheets

FEATURE IN FIRING CHAMBER OF FLUID EJECTION DEVICE

FIELD OF THE INVENTION

The present invention relates to fluid ejection devices, such as those used in fluid ejection cartridges.

BACKGROUND OF THE INVENTION

When a fluid or ink droplet is ejected from a nozzle or orifice of a printhead, most of the mass of the droplet is contained in the leading head of the droplet. The greatest velocity of the droplet is found in this mass. The remaining tail of the droplet contains a minority of the mass of ink and has a distribution of velocity ranging from nearly the same as the ink droplet head at a location near the ink droplet head to a velocity less than the velocity of the ink found in the ink droplet head and located closest to the orifice aperture. At some time during the transit of the droplet, the ink in the tail is stretched to a point where the tail is broken off from the droplet. A portion of the ink remaining in the tail is pulled back to the printhead orifice plate where it typically forms puddles of ink surrounding the orifice. These ink or fluid puddles, if not controlled, degrade the quality of the printed material by causing misdirection of subsequent ink droplets.

Some parts of the ink droplet tail are absorbed into the ink droplet head prior to the ink droplet being deposited upon the medium. However, other parts of the ink droplet tail neither returns to the printhead nor remains with or is absorbed in the ink droplet, but produces a fine spray of subdroplets spreading in a random direction. Some of this spray reaches the medium upon which printing is occurring thereby producing rough edges to the dots formed by the ink droplet and placing undesired spots on the medium which reduces the clarity of the desired printed material.

It is desirable to minimize fluid droplet tails, as well as the corresponding fluid puddles and spray.

SUMMARY OF THE INVENTION

In an embodiment of the present invention, a fluid ejection device has a firing chamber with a feature disposed therewithin.

Many of the attendant features of this invention will be more readily appreciated as the same becomes better understood by reference to the following detailed description and considered in connection with the accompanying drawings in which like reference symbols designate like parts throughout.

BRIEF DESCRIPTION OF THE DRAWINGS

FIGS. 3 to 5A illustrate alternative embodiments of the feature of the present invention;

DETAILED DESCRIPTION

Figure 1:
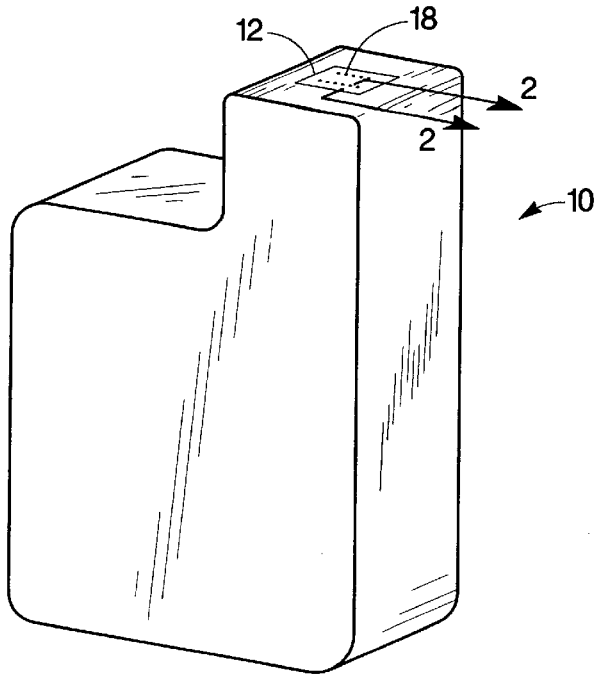
FIG. 1 illustrates a perspective view of a fluid ejection cartridge of an embodiment of the present invention.
Figure 2:
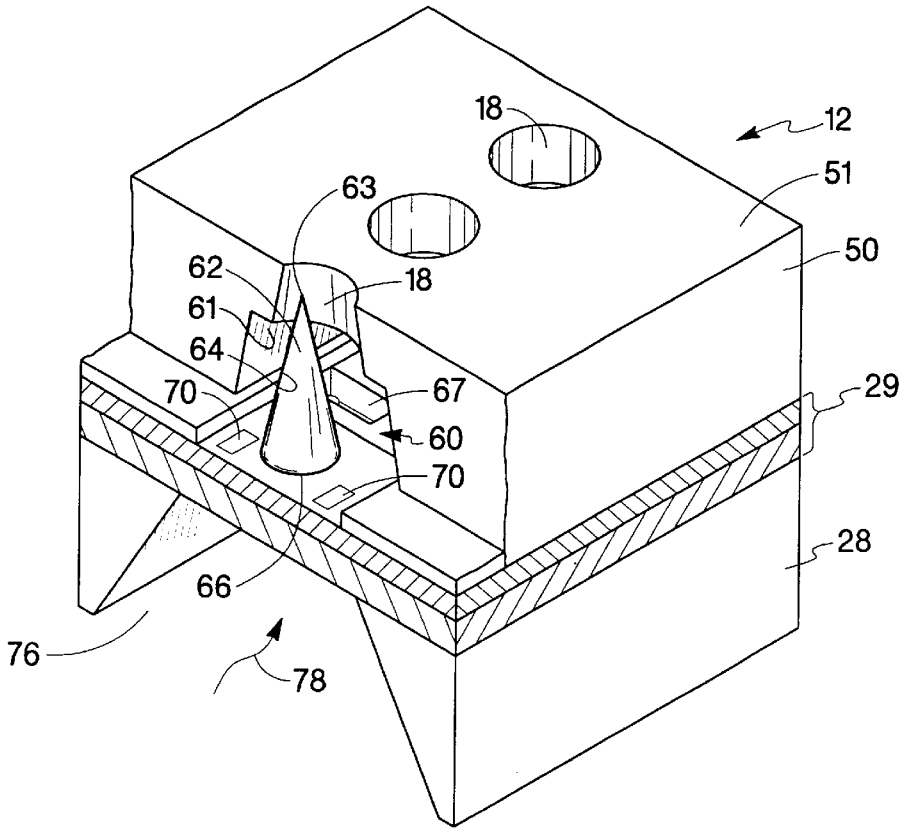
FIG. 2 illustrates an embodiment of the feature of the present invention through section 2—2 of FIG. 1.

FIG. 1 is a perspective view of an inkjet cartridge (or fluid ejection cartridge) 10 with a printhead (or fluid ejection device) 12 of the present invention. FIG. 2 illustrates a cross-sectional view of the fluid ejection device through section 2—2 of FIG. 1. In FIG. 2, a thin film stack (or circuit element) 29 is applied over a substrate 28. The circuit element 29 includes a plurality of resistors (or heating elements) 70. The resistors shown in the following embodiments are substantially square or rectangular, however, they are not so limited.

A barrier (or orifice) layer 50 is applied over the thin film stack 29. Inner walls 61 of the barrier layer 50 form a plurality of firing chambers 60 that are associated with the plurality of heating elements 70.

A plurality of orifices 18 are formed through a top surface 51 in the barrier or orifice layer 50 and are associated with the firing chambers 60. As shown more clearly in the printhead 12 of FIG. 1, the nozzle orifices 18 are arranged in rows located on both sides of the printhead 12. The orifices shown in the following embodiments are substantially circular or elliptical, however, they are not so limited. The orifices may be substantially square or rectangular.

A trench or slot 76 is formed in the substrate 28 to fluidically communicate the fluid ejection device 12 with a fluid container or reservoir (not shown) in the fluid ejection cartridge 10. Fluid flows (as shown by arrow 78) through the trench 76 through a fluid feed slot 67 in the thin film stack 29 to the firing chamber 60. The fluid is heated in the firing chamber 60 by the heating element(s) 70 and is ejected out the respective orifice 18.

In this embodiment, the barrier layer 50 is formed of an organic polymer which is substantially inert to the corrosive action of ink. In one particular embodiment, the barrier layer 50 is formed of PECVD oxide. In yet another embodiment, the barrier layer 50 is a fast cross-linking polymer, such as photoimagable epoxy (such as SU8 developed by IBM), photoimagable polymer or photosensitive silicone dielectrics, such as SINR-3010 manufactured by ShinEtsu™. In an alternative embodiment, an additional layer (a top orifice layer) is applied over the barrier layer 50 and forms the orifices 18. An example of the physical arrangement of the barrier layer, and thin film substructure is illustrated at page 44 of the Hewlett-Packard Journal of February 1994. Further examples of ink jet printheads are set forth in commonly assigned U.S. Pat. Nos. 4,719,477, 5,317,346, and 6,162,589.

As shown in the embodiment of FIG. 2, a feature 62 is disposed within the firing chamber 60. In the embodiment shown, the feature 62 is a drop-directionality feature in that the feature aids in determining the direction of the fluid drop through the orifice. In another embodiment, the feature 62 substantially and consistently dictates the location of break-off of the tail of the fluid drop in the orifice 18 or barrier layer 50. In a more particular embodiment, the tail break-off is in substantially the center of the orifice. It is believed that when the tail breaks off in the center of the orifice, it has less of a tendency to displace the straight-ahead trajectory of the main drop. In one embodiment, the height of the feature is at least long enough to influence the tail break-off from the fluid remaining in the firing chamber. In another embodiment, each fluid drop has a main dot and satellite dots. The satellite dots land in a substantially consistent location on the media relative to the main dot using the feature 62 described herein.

In the embodiment shown in FIG. 2, the feature 62 is substantially cone-shaped. The shape of the feature is not so limited, and more examples of feature shapes are discussed herein. The feature has a tip (or pointed tip) 63 at one end nearest the orifice 18, and a base 66 at another end nearest the resistors 70. The feature has side walls 64 in between the base 66 and tip 63. In this embodiment, the side walls 64 taper towards the orifice 18, in that the base is larger in area than the tip. The tip 63 in this embodiment extends to a plane defining the top surface 51 of the barrier layer. In other embodiments, the tip 63 extends to a plane beneath the top surface and within the barrier layer. In this embodiment, the side walls 64 are substantially parallel to the side walls 61 of the chamber. The orientation of the side walls 61 of the chamber is not so limited, and other examples of side wall 61 orientations are described herein.

Figure 3:
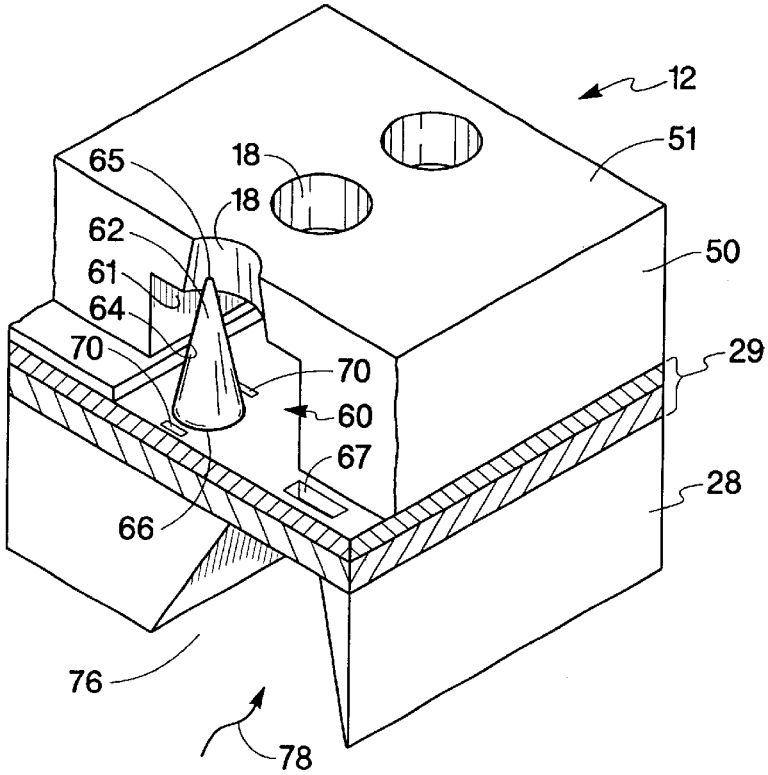

As shown in the embodiment of FIG. 3, the feature 62 is substantially cone-shaped and similar to the embodiment described in FIG. 2. One of the primary differences between these two embodiments lies with the feature 62. In this embodiment, the feature 62 has a top surface 65. In this embodiment, the top surface 65 is substantially flat. Because of the substantially cone-shaped feature, the top surface is substantially circular. The top surface 65 in this embodiment extends to be in substantially the same plane as that which is defined by the top surface 51 of the barrier layer. In other embodiments, the top surface 65 extends to a plane beneath the top surface and within the barrier layer. The chamber walls 61 in this embodiment are substantially straight, more particularly, the walls 61 are substantially perpendicular to the base 66 of the feature 62.

Another difference between the embodiments shown in FIGS. 2 and 3 is the structure of the fluid ejection device 12. In FIG. 3, the trench or slot 76 is offset in the substrate 28 with respect to the firing chamber 60. The fluid 78 flows through the trench 76 in the substrate 28 and through the fluid feed slot 67. As shown in FIG. 3, the fluid then is directed in a substantially perpendicular direction towards the firing chamber. More particularly, the fluid is directed by a channel in the layer 50 towards the firing chamber 60.

Generally in the embodiment of FIG. 3, there is one fluid feed slot 67 and two heating elements 70 associated with each firing chamber 60. The heating elements (or fluid ejectors) 70 in the embodiment of FIG. 3 are positioned in a staggered row along the trench 78. In between pairs of the heating elements is positioned the feature 62.

Figure 4:
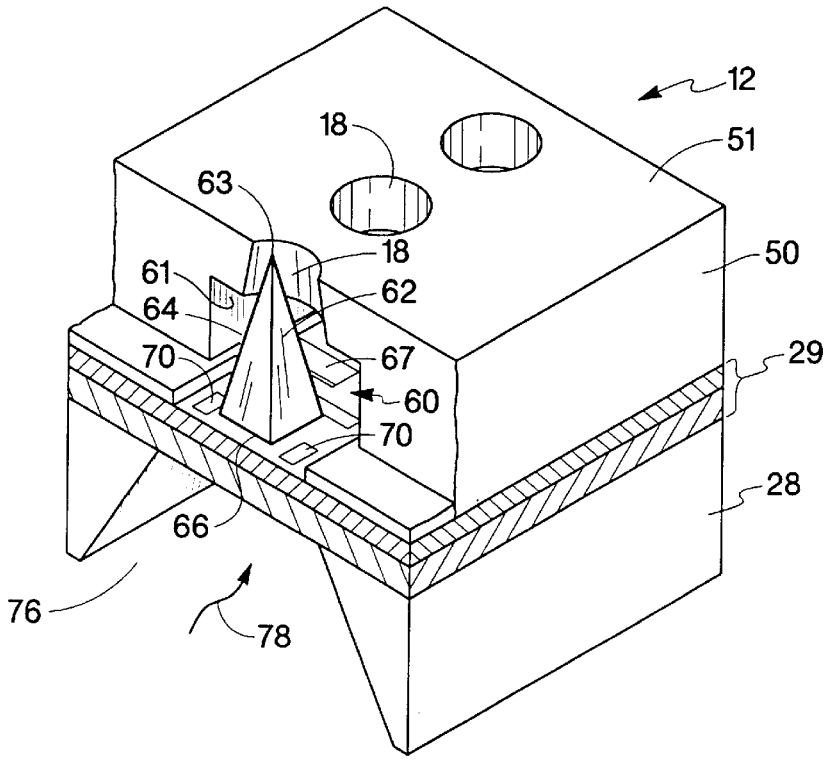

The feature 62 of the embodiment shown in FIG. 4 is substantially shaped as a pyramid. The pyramid illustrated has four (4) sides or side walls 64. However, the number of side walls is not so limited. For example, in alternative embodiments, the pyramid has three (3) sides or greater than four (4) sides. The pyramid has a base 66 that is shaped substantially square in the embodiment shown. In this embodiment, the pyramid has a tip 63 at the end nearest the orifices. In alternative embodiments, the tip of the pyramid is cut-off to expose a substantially flat top surface similar to that of FIG. 3.

In the embodiment shown, the chamber walls 61 are substantially perpendicular to the base 66 of the feature. Again, the chamber walls 61 are not so limited, and may be oriented to substantially slope with the pyramidal side walls 64 such that the distance between the feature 62 and the sidewalls 61 remain substantially the same throughout the firing chamber, and the walls of the chamber and the feature are substantially parallel in cross-section.

Figure 5A:
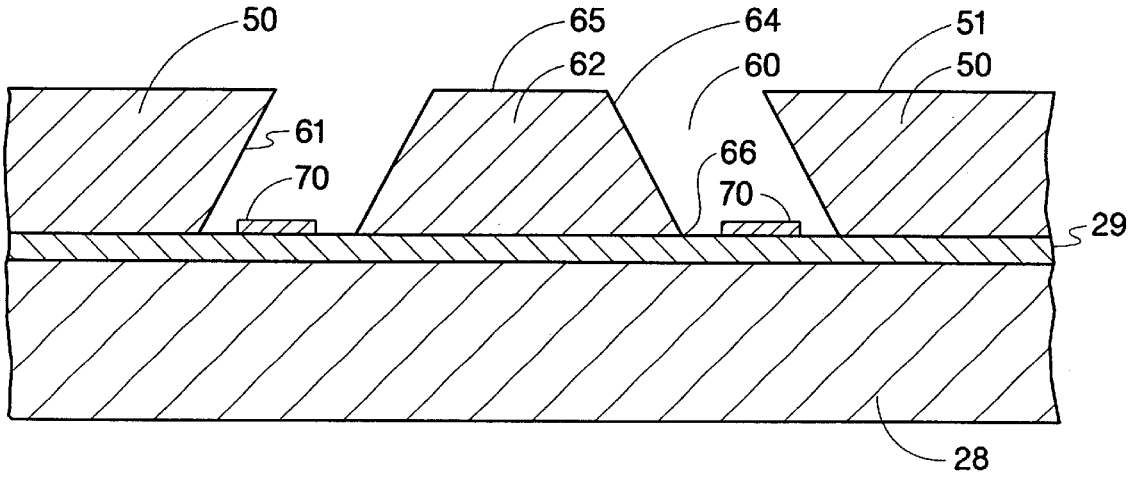

In the embodiment shown in FIG. 5A, the feature 62 is similar to that of FIG. 3. FIG. 5A illustrates a side cross-sectional view of the feature 62 in the firing chamber. In the embodiment shown, the top surface 65 of the feature is substantially flush with the top surface 51 of the barrier layer and/or the orifice layer, if applicable. The chamber walls 61 are oriented to substantially follow the slope of the feature walls 64.

Figure 5B:
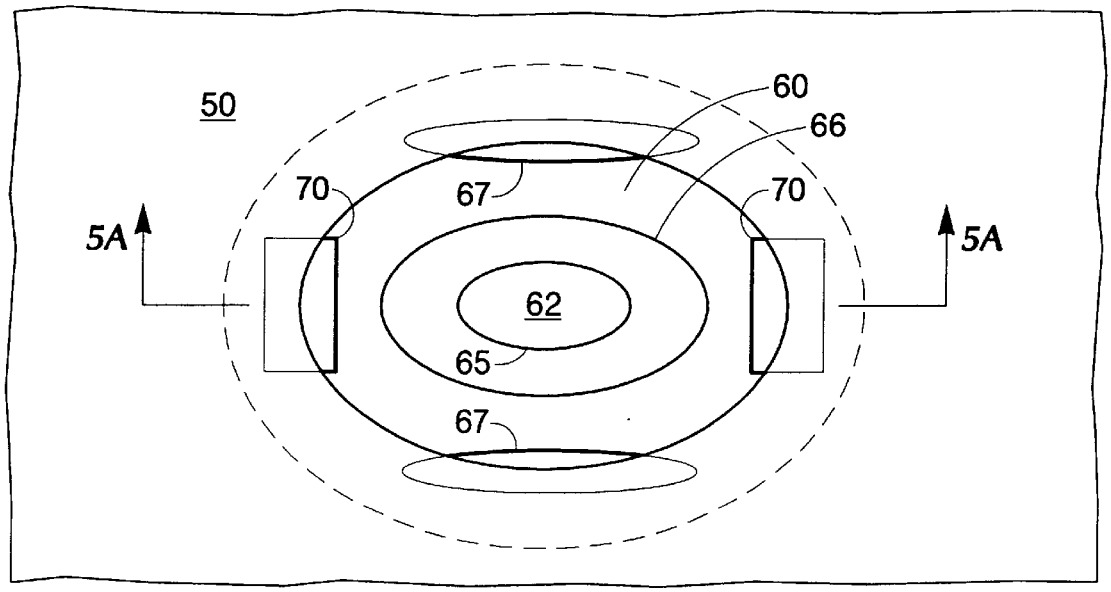
FIG. 5B illustrates a plan view of FIG. 5A.

FIG. 5B illustrates a plan view of the feature 62 in the firing chamber 60 of FIG. 5A. FIG. 5B illustrates that the feature 62 is substantially elliptical in cross-section, and thus the top surface 65 is substantially elliptical, as the base 66 is substantially elliptical. However, the feature may also have a substantially rectangular cross-section along the top surface 65 and the base 66. In this embodiment, the orifice 18 is substantially annular with the feature being substantially central to the orifice.

As shown in FIG. 5B, the resistors 70 are shown on two opposing sides of the base 66 of the feature, while the fluid feed slots 67 are shown on the other of the two opposing sides of the base 66. In this embodiment, the fluid feed slots 67 are shown as substantially elliptical, but are not so limited. In another embodiment (not shown), the fluid enters the firing chamber from a channel that is substantially from the side of the firing chamber, rather than from the slots 67 'underneath' as shown in FIG. 5B.

The area of the annular exit (nozzle orifice) determines the drop weight, while the width of the gap between the feature and the exit bore (or the chamber walls) determines the capillary forces acting on the fluid. Thus, in at least one of the embodiments of the present invention, the feature allows the refill speed of the firing chamber to increase without sacrificing drop weight of the fluid to be ejected. A relatively large drop is allowed to be ejected, while maintaining a high capillary force on the fluid, hence a fast refill of the chamber for a given drop weight.

Figure 6:
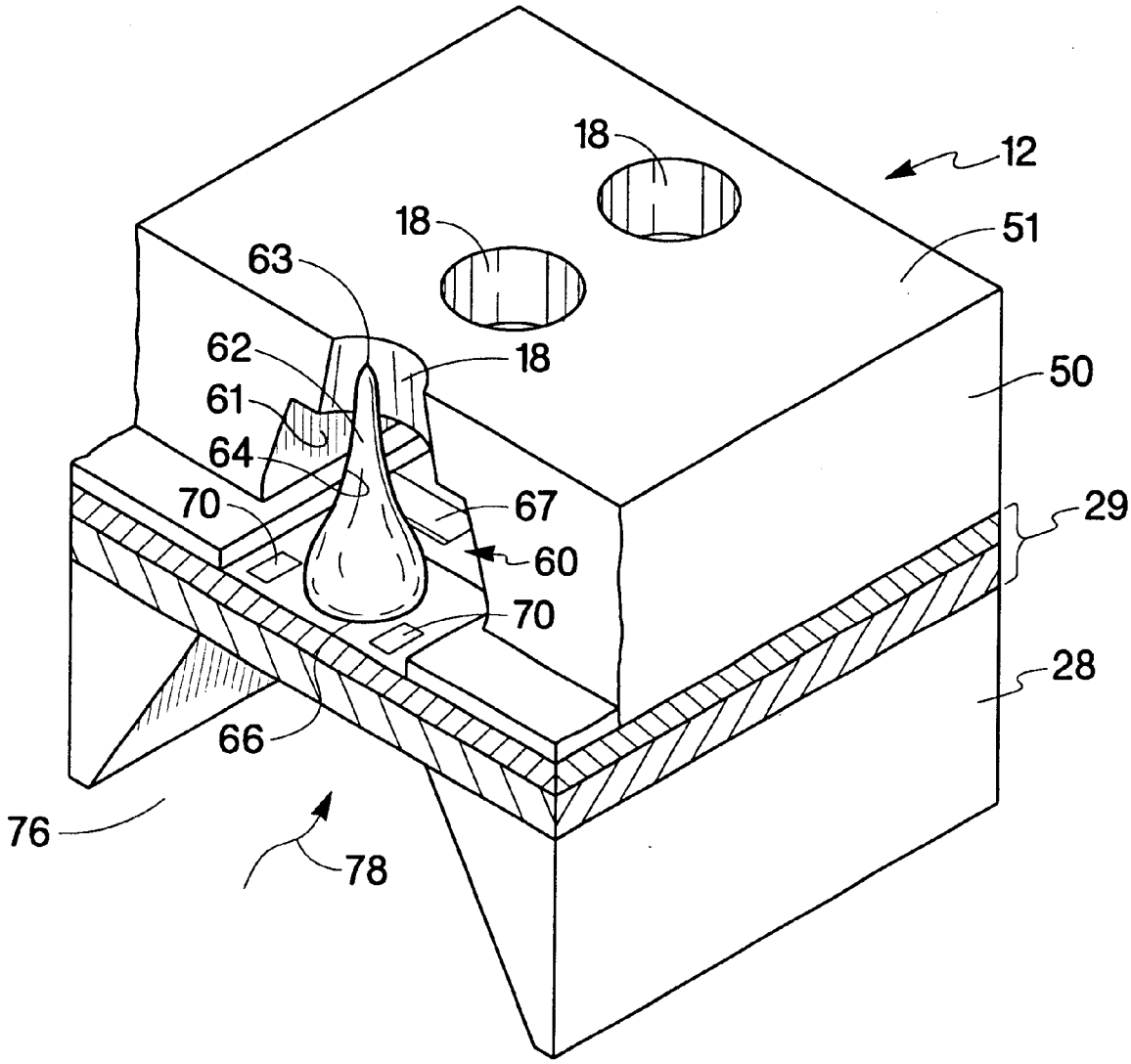
FIG. 6 illustrates an alternative embodiment of the feature of the present invention.

FIG. 6 illustrates another embodiment of the feature 62 having curved walls 64. In this embodiment, the chamber side walls 61 are substantially concavely curved to correspond with the curved feature walls 64. In this embodiment, a cross-section of the feature is substantially circular.

Figure 7A:
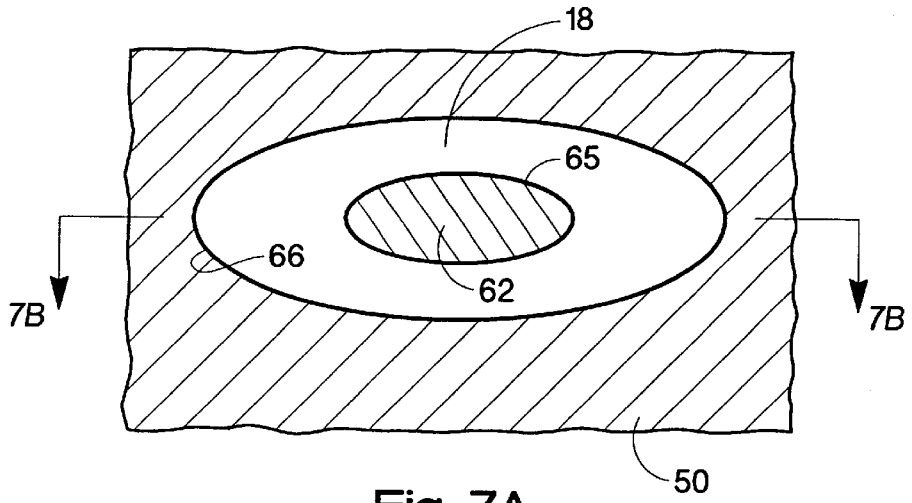
FIGS. 7 through 8 illustrate more alternative embodiments of the feature of the present invention.

FIG. 7A illustrates a top view of another embodiment of the fluid ejection device. The orifice has a substantially elliptical-annular shape, as the feature 62 is positioned substantially in the center of the orifice 18. In embodiments such as those shown in FIGS. 5A, and 7A, where the top surface of the feature is substantially flush with the top surface 51 of the barrier layer, the orifice 18 has a substantially annular shape. With numerical modeling, it has been shown that as fluid exits the annular top of the firing chamber in an unstable toroidal shape, the tendency is to pull the fluid towards the center of the toroid, and thereby minimize the aerosol or spray created by the ejection.

Figure 7B:
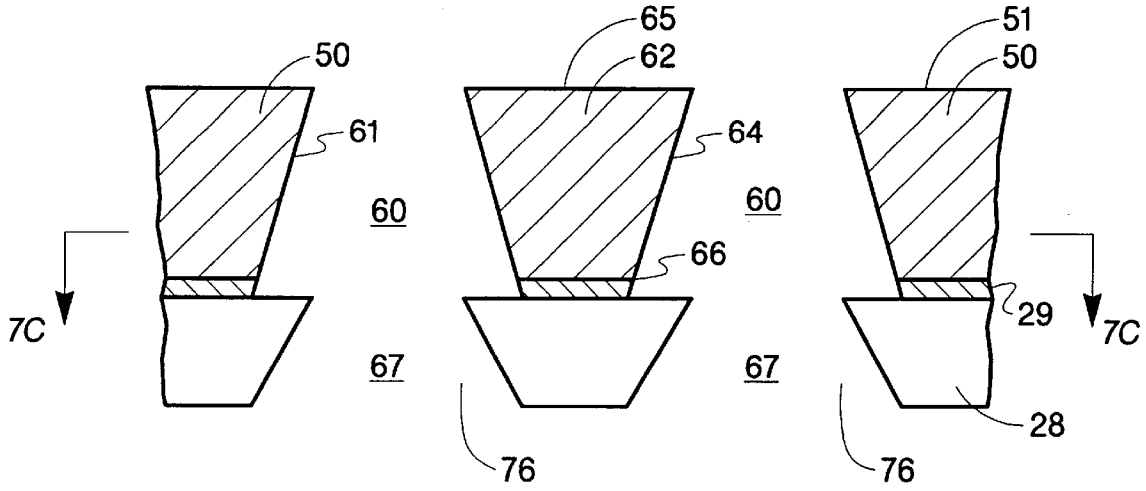
Figure 7C:
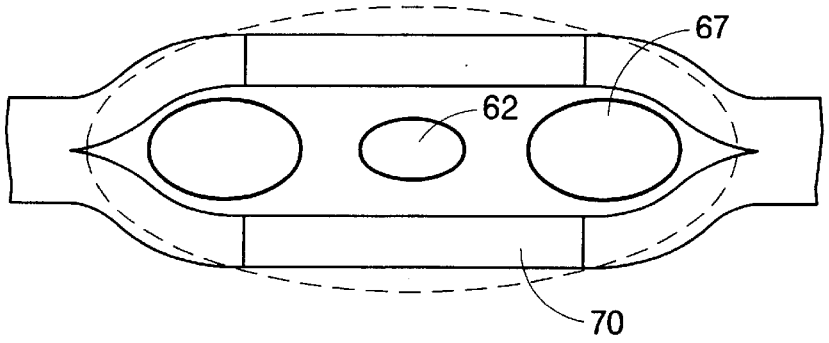

FIG. 7B illustrates the cross-sectional view of the feature 62 in the firing chamber 60. Fluid feed slots 67 fluidically couple the trench 76 with the firing chamber 60. In this embodiment, the feature is cone-shaped and substantially elliptical in cross-section. The feature tapers down from the top surface 65 to the base 66, such that the top surface of the feature has a larger cross-sectional area than the base. FIG. 7C illustrates the cross-sectional view of the fluid ejection device taken from near the base 66 of the feature in FIG. 7B.

Figure 8A:
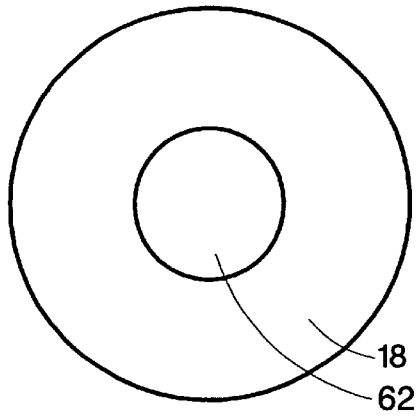
Figure 8B:
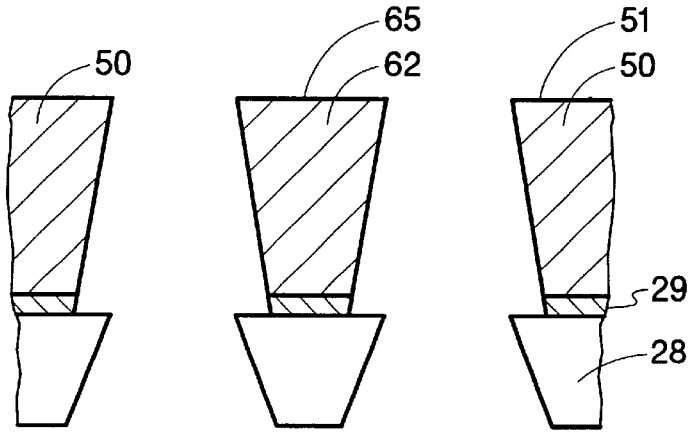
Figure 8C:
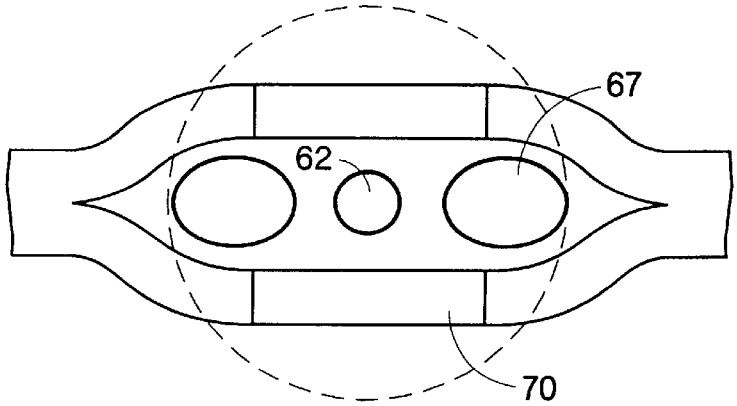

The embodiment shown in FIGS. 8A to 8C is substantially similar to the embodiment shown in FIGS. 7A to 7C. The primary difference in this embodiment is that the feature 62 is more particularly substantially circular in cross-section.

Figure 9A:
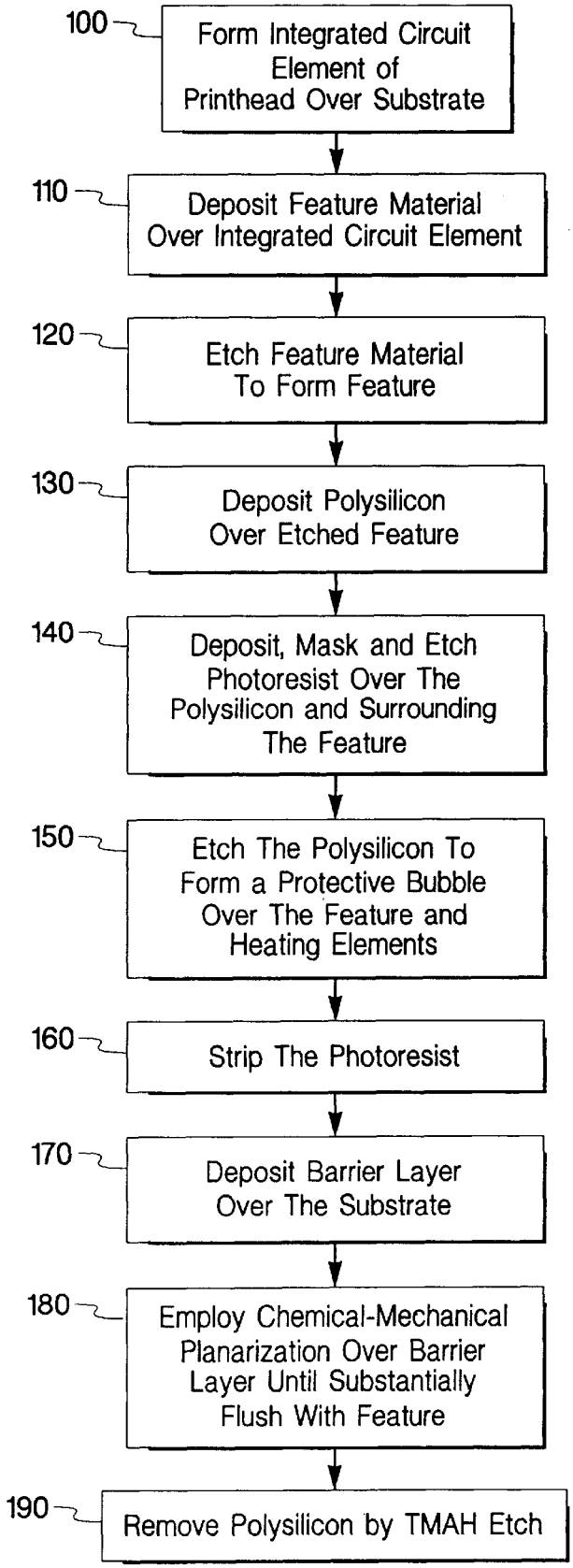
FIG. 9A illustrates a flow chart of one embodiment for forming the feature.
Figure 10:
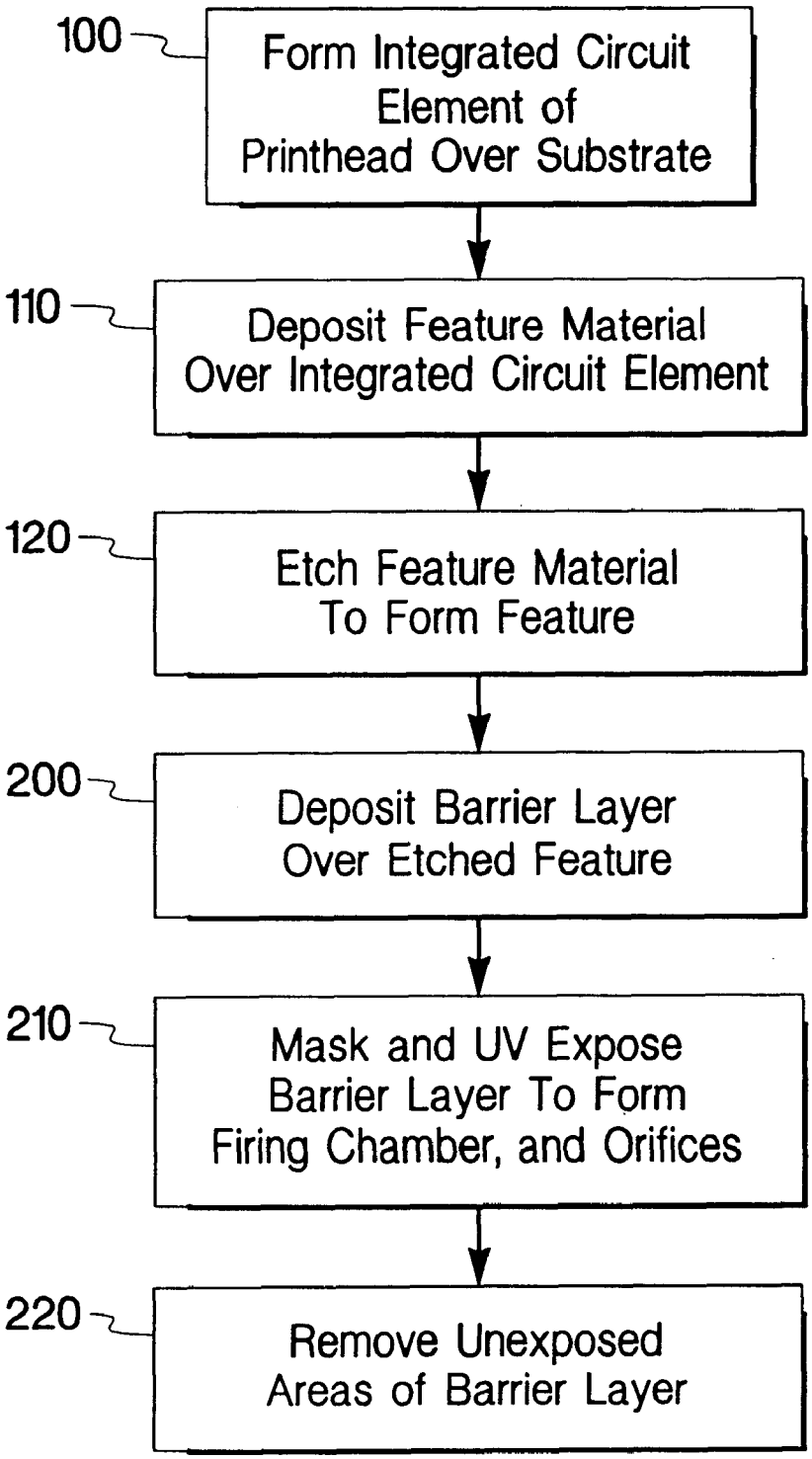
FIG. 10 illustrates a flow chart of another embodiment for forming the feature.
Figure 11:
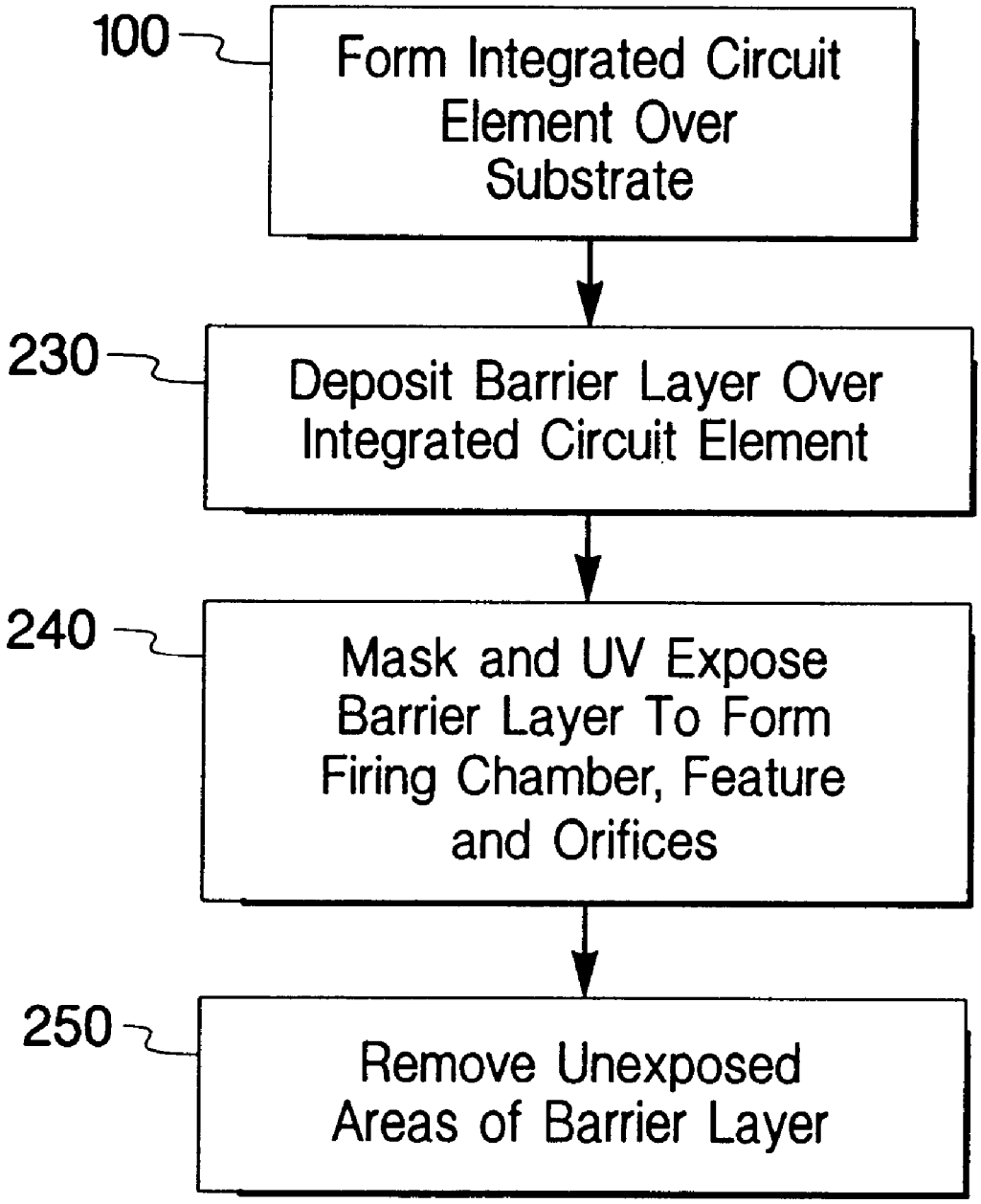
FIG. 11 illustrates a flow chart of yet another embodiment for forming the feature.

The flow charts of FIGS. 9A, 10 and 11 illustrate several embodiments of forming the feature 62. The embodiment of FIG. 9A shows that the integrated circuit element 29 (including the heating elements 70) of the printhead 12 is formed over the substrate 28 at step 100. In step 110, a feature material is deposited over the integrated circuit element. In one embodiment, the feature material is preferably ink and/or TMAH etchant resistant. In a more particular embodiment, the feature material is silicon dioxide. In another embodiment, the feature material is a barrier material described herein, such as DOW-Cyclotone 3022-63, or a similar polymer, or a photoimagable polyimide or polymer such as SU8.

Figure 9B:
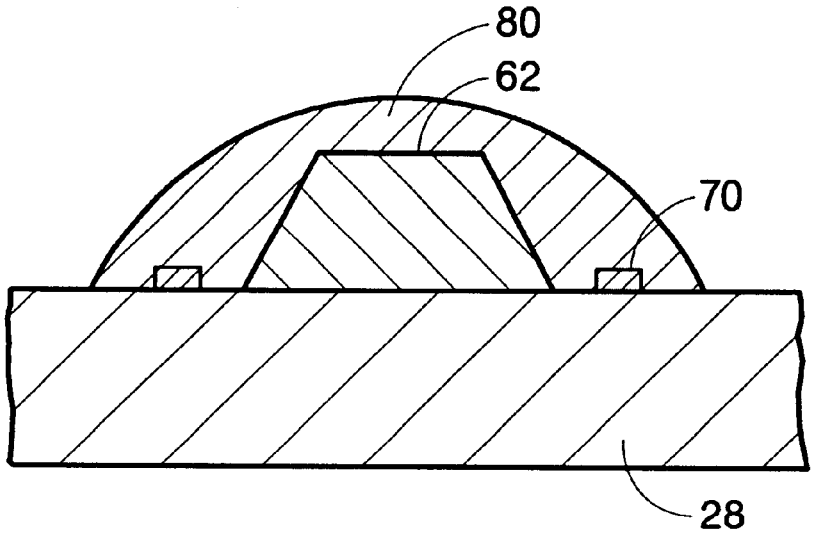
FIGS. 9B and 9C illustrates the forming of the feature as described in the steps of FIG. 9A.
Figure 9C:
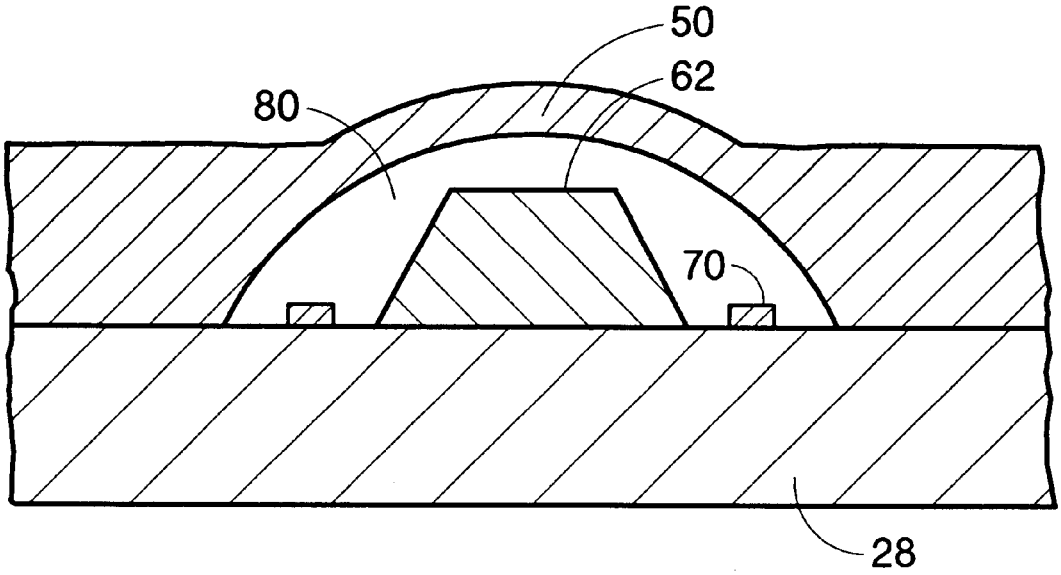

In step 120 of FIG. 9A, the feature material is etched to form the desired feature shape over the circuit element 29. In step 130, polysilicon 80 is deposited over the etched feature. In step 140, photoresist material is deposited over the polysilicon and areas surrounding the feature. The photoresist is masked and etched. In step 150, the polysilicon 80 is etched to form a protective bubble over the feature and heating elements, as shown in FIG. 9B. The remaining photoresist is stripped in step 160. In step 170, barrier layer material is deposited over the polysilicon 80 bubble, as illustrated in the embodiment shown in FIG. 9C.

In step 180, chemical-mechanical planarization is employed to the barrier layer material and the polysilicon 80 until the top surface 51 of the barrier layer 50 is substantially flush with the top surface 65 of the feature 62. After step 180, the cross-section is substantially similar to FIG. 5A except that the firing chambers 60 are filled with the polysilicon material 80. In step 190, the polysilicon 80 is removed by etching, such as using a TMAH etch.

FIG. 10 describes an embodiment that is similar to FIG. 9A. FIG. 10 uses SU8 or another photoimagable material as the barrier material in this embodiment. Steps 100 to 120 are employed in this embodiment as in that of FIG. 9. In one embodiment, the feature is formed of silicon dioxide, and in another embodiment, the feature is formed of a photoimagable material.

After the feature is formed in step 120, the barrier layer material is deposited over the feature 62. The barrier layer material is then masked to form the firing chambers and orifices in step 210. In one embodiment, a chrome mask is used in the masking step. The barrier layer materials are then UV exposed to form the firing chamber and corresponding orifices. An example of the masked and UV exposure of the barrier layer material to form barrier layers, firing chambers, and/or orifices, etc. is illustrated in commonly assigned U.S. Pat. No. 6,162,589 issued Dec. 19, 2000. In step 220 of this embodiment, the unexposed areas are developed and thereby removed to form the firing chambers.

In step 100 of the embodiment of FIG. 11, the integrated circuit element is formed over the substrate, as in the previous embodiments. Step 230 is to deposit the material for the barrier layer 50 over the integrated circuit element. This embodiment uses SU8 or another photoimagable material as the barrier layer material. In step 240, the barrier layer is masked and exposed to UV radiation to form the firing chamber, the feature, as well as the orifices, as discussed above. In this embodiment, the feature and firing chamber are formed of the same photoimagable material. In step 250, the unexposed areas of the barrier layer are removed, as discussed above.

While the present invention has been disclosed with reference to the foregoing specification and the preferred embodiment shown in the drawings and described above, it will be apparent to those skilled in the art that changes in form and detail may be made therein without departing from the spirit and scope of the invention as defined by the appended claims. For instance, the feature may be shaped substantially as a rectangular box. In addition, each feature shape, top surface formation, feature tip, feature wall formation, and chamber wall formation are interchangable with each other, and are not limited to the specifically described embodiments.

We claim:

1. A fluid ejection device comprising:

a firing chamber having an orifice; and a feature disposed in the firing chamber extending towards the orifice, wherein the feature has a substantially conical shape; and a heating element disposed about a base of the feature.

2. The fluid ejection device of claim 1 wherein the feature tapers toward the orifice.

3. The fluid ejection device of claim 1 wherein the orifice has a substantially annular shape.

4. The fluid ejection device of claim 1 wherein the feature has a substantially circular cross-section.

5. The fluid ejection device of claim 1 wherein the firing chamber has side walls that are substantially parallel to side walls of the feature.

6. A fluid ejection device comprising:

a firing chamber having an orifice; and a feature disposed in the firing chamber extending towards the orifice, wherein the orifice is formed in an orifice layer having a top surface, wherein the feature has a pointed tip, and the pointed tip is substantially flush with the top surface of the orifice layer; and a heating element disposed about a base of the feature.

7. The fluid ejection device of claim 6 wherein the heating element includes at least two resistors surrounding the base of the feature.

8. The fluid ejection device of claim 6 wherein the feature is formed of a polymer.

9. The fluid ejection device of claim 6 wherein the feature is formed of an oxide.

* * * * *